US006212687B1

(12) United States Patent
Kwon

(10) Patent No.: US 6,212,687 B1
(45) Date of Patent: Apr. 10, 2001

(54) GOLF GLOVES

(76) Inventor: Young-Wook Kwon, 612-404 Kachimaeul Kunyoung Villa, 13 Kumi-Dong, Pundang-Gu, Seongnam-City, Kyungki-Do (KR)

( * ) Notice: Subject to any disclaimer, the term of this patent is extended or adjusted under 35 U.S.C. 154(b) by 0 days.

(21) Appl. No.: 09/461,723

(22) Filed: Dec. 16, 1999

(30) Foreign Application Priority Data

Nov. 29, 1999 (KR) ..... 99-53547

(51) Int. Cl.[7] ..... A41D 19/00
(52) U.S. Cl. ..... 2/161.3; 473/205
(58) Field of Search ..... 2/159, 160, 161.1, 2/161.2, 161.3, 161.5, 161.6, 163, 166, 167; 473/205

(56) References Cited

U.S. PATENT DOCUMENTS 3,508,280 * 4/1970 Osborn ..... 2/161.1
4,587,673 * 5/1986 Boliard ..... 2/161
4,665,565 * 5/1987 Odom ..... 2/161
4,864,659 * 9/1989 Morris ..... 2/161
5,028,050 * 7/1991 Freyer ..... 273/183
5,184,827 * 2/1993 Suttle et al. ..... 273/187.2
5,316,294 * 5/1994 Turangan ..... 273/65

* cited by examiner

*Primary Examiner*—John J. Calvert
*Assistant Examiner*—Katherine Moran
(74) *Attorney, Agent, or Firm*—Smith Patent Office

(57) ABSTRACT

Golf gloves are disclosed. The golf gloves worn by a golfer while swinging a golf club comprise main fastening means consisting of first two opposite parts. The first two opposite parts are respectively fixed on both palm sides of the gloves and are attachable to each other when pressed into contact with each other. The golf gloves may further comprise auxiliary fastening means consisting of second opposite parts. The second opposite parts are respectively fixed on the side edges of the fingers of the gloves and are attachable to each other when pressed into contact with each other. The main fastening means may be fixed on the heel pad of the palm of each of said gloves. The auxiliary fastening means may be fixed on the contacted side edges of the interlaced fingers of each of the gloves. The main fastening means and the auxiliary fastening means may be Velcro fastening tapes.

7 Claims, 5 Drawing Sheets

GOLF GLOVES

BACKGROUND OF THE INVENTION

1. Field of the Invention

The present invention relates, in general, to golf gloves and, more particularly, to golf gloves for preventing an unstable grip when a swing is performed.

2. Description of the Prior Art

As well known to those skilled in the art, golf clubs are typically classified into three types; "woods" having large and voluminous heads, "irons" having smaller and narrower heads, and "putters" having longer heads and shorter shafts. The "woods" are generally used for making longer-distance drive shots, the "irons" are generally used for making shorter-distance shots and the "putters" are generally used for making putts. Generally, golfers may perform swings using such golf clubs.

A golfer performs a swing with his both hands holding the grip portion of a golf club. A grip in golf, which is an act of holding fast the grip portion of a golf club with the golfer's both hands, serves to connect the golfer with the golf club and to transmit power from the golfer to the head of the golf club through a swing.

Therefore, the grip is very important in golf. That is, in case that the grip is not properly performed, the golfer may not transmit power to the golf club sufficiently and the swing posture may be deteriorated. For example, one possible insufficient grip may cause a horizontal side swing, thereby undesirably sending the golf ball to the left or to the right. On the other hand, another possible insufficiently may cause a vertical swing and prevent the golfer from performing a proper, pull back swing, thereby resulting a duff or a top.

In FIG. 1, an initial stage for achieving a right-handed golfer's proper grip is illustrated. As shown in the drawing, the grip portion 12 of a golf club 10 is firstly held by the left hand 14, with the thumb 18 of the left hand 14 pressing the grip portion 12, the thumb 18 being biased to the right and the wrist of the left hand 14 being over the grip portion 12. Secondly, the grip portion 12 of the golf club 10 is held by the right hand 16, with the right hand 16 covering the thumb 18 of the left hand 14 at its palm, the thumb 22 of the right hand 16 pressing the grip portion 12 and the thumb 22 of the right hand 16 being biased to the left. At this time, the index finger 28 of the left hand 14 and the third and little fingers 24 and 30 of the right hand 16 are interlaced together, while the little finger 30 of the right hand 16 and the index and third fingers 28 and 32 of the left hand 14 are interlaced.

That the grip portion 12 of the golf club 10 is properly gripped by both hands 14 and 16 is illustrated in FIG. 2.

On the other hand, when swinging the golf club, the golfer must press the golf club 10 with the heel pads 20 and 26 of the palms of the left and right hands 14 and 16 until the swing action is completed, so as to send a golf ball to the desired direction and transmit unimpaired power to the ball. The term "heel pad" refers to the swelled portion, adjacent to the thumb, of the palm of the hand in this entire specification.

However, a beginner may press the golf club 10 with the heel pads 20 and 26 of the palms of the left and right hands 14 and 16 in the initial stage of the address action, but may not keep this proper grip in later stages of the back-swing action, the down-swing action, the point of impact or the follow-through action, thus failing to perform a proper swing.

SUMMARY OF THE INVENTION

Accordingly, the present invention has been made keeping in mind the above problems occurring in the prior art, and an object of the present invention is to provide golf gloves, allowing the heel pads of the palms of a golfer's both hands to continuously press fast the grip portion of a golf club during a whole swing action.

Another object of the present invention is to provide golf gloves, allowing a golfer to master a proper grip through practice using the gloves so as to be trained to make a proper grip even with the gloves being removed.

A further object of the present invention is to provide golf gloves, improving the force of gripping while swinging a golf club.

In order to accomplish the above object, the present invention provides golf gloves worn by a golfer while swinging a golf club, comprising main fastening means consisting of first two opposite parts, the first two opposite parts respectively fixed on both palm sides of the gloves and being attachable to each other when pressed into contact with each other.

According to another embodiment of the present invention, the golf gloves further comprise auxiliary fastening means consisting of second opposite parts, the second opposite parts respectively fixed on the side edges of the fingers of the gloves and being attachable to each other when pressed into contact with each other.

According to a further embodiment of the present invention, the main fastening means is fixed on the heel pad of the palm of each of said gloves.

According to yet another embodiment of the present invention, the auxiliary fastening means is fixed on the contacted side edges of the interlaced fingers of each of the gloves.

According to still further embodiment of the present invention, the main fastening means and the auxiliary fastening means are VELCRO hook and loop fastening tapes.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
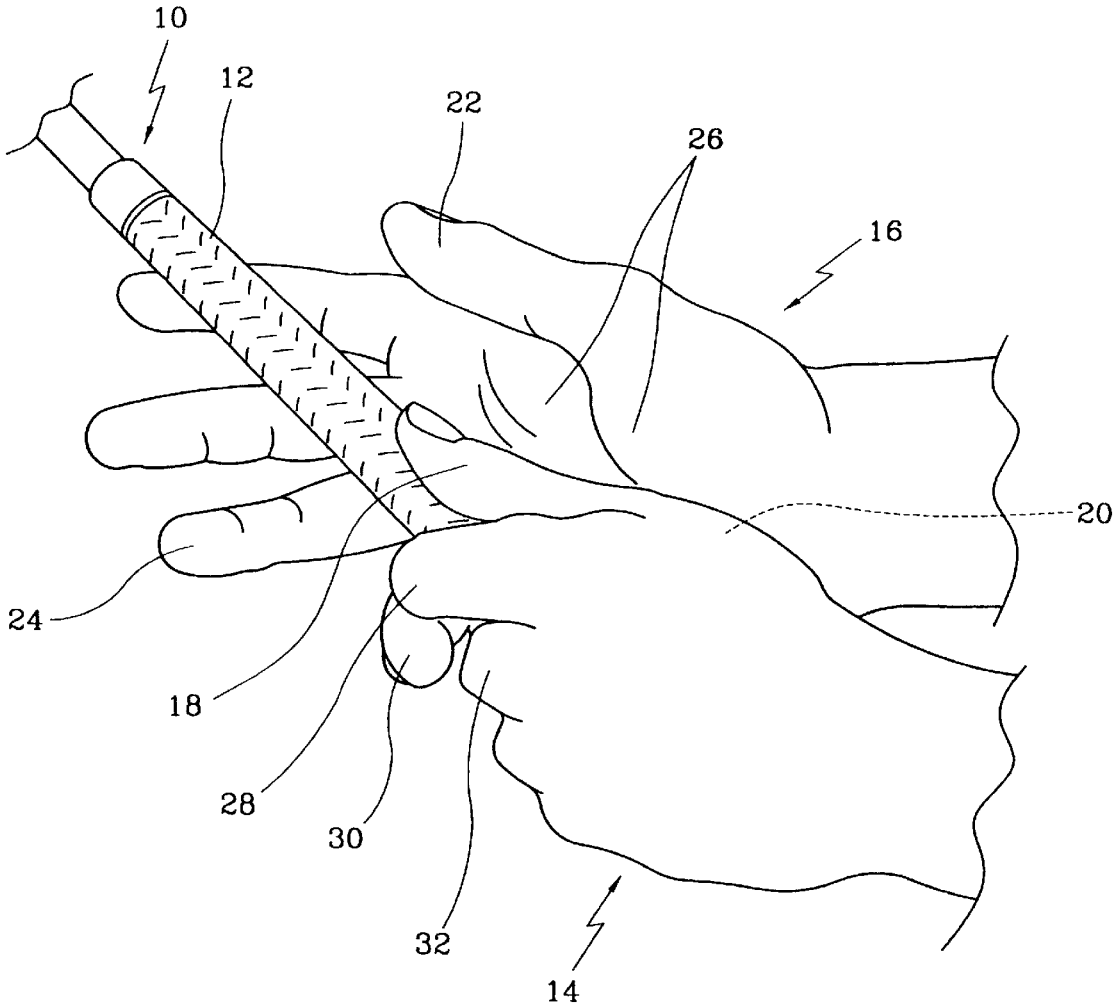
FIG. 1 illustrates an initial stage for achieving a proper grip.
Figure 2:
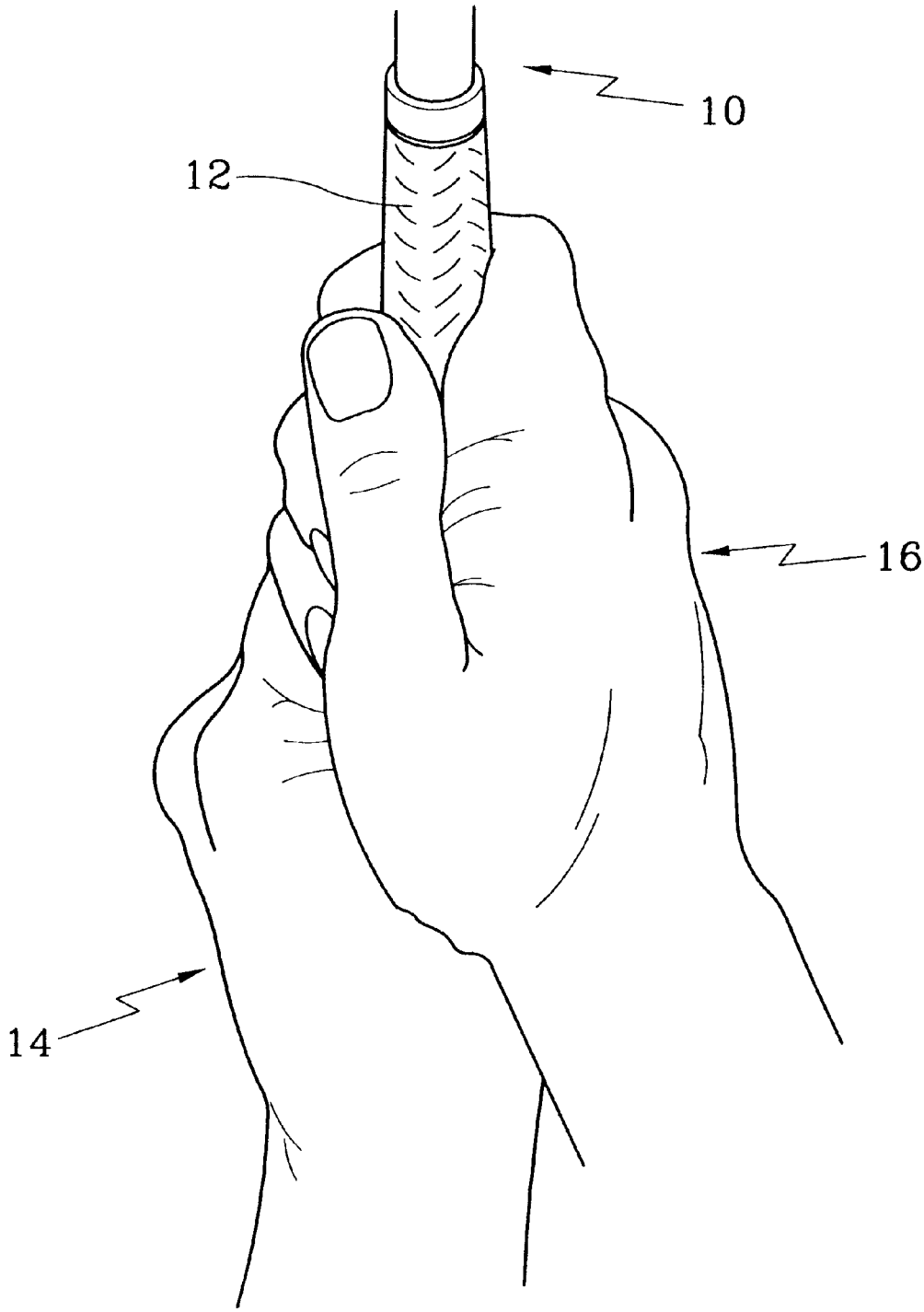
FIG. 2 is a view showing that the grip portion 12 of the golf club 10 is properly gripped by both hands 14 and 16.
Figure 3:
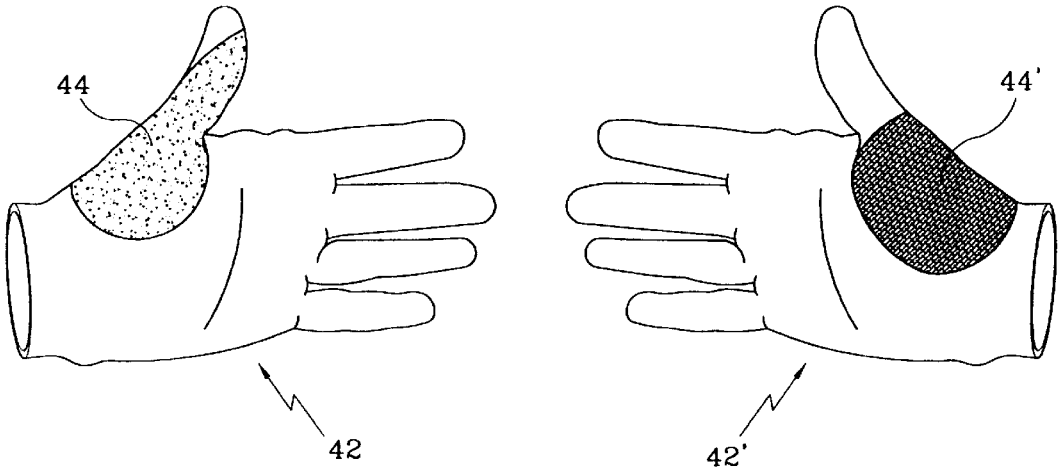
FIG. 3 is a view showing the palm sides of golf gloves according to a first embodiment of the present invention.

FIG. 3 is a view showing the palm sides of golf gloves according to a first embodiment of the present invention. As shown in the drawing, the gloves 42 and 42' are provided with a Velcro hook and loop fastening tape at their palm sides. In more detail, one fabric piece 44 of the tape with a dense nylon pile is fixed on the palm side of the thumb and the heel pad of the palm of the left hand glove 42, while the other fabric piece 44' of the tape with a dense arrangement of tiny nylon hooks is fixed on the heel pad of the palm of the right hand glove 42', so that the fabric pieces 44 and 44' interlock when pressed into contact with each other.

The gloves 42 and 42' may be made of leather (such as roan, cowhide, etc.) or synthetic fiber (such as synthetic roan). In order to firmly grip a golf club, the palms of the gloves 42 and 42' may be coated with a well-known special silicone. Additionally, the gloves 42 and 42' may be manufactured of porous material so as to be well ventilated.

In the right hand glove, the thumb is free from the tape. Incidentally, the pieces 44 and 44' may be fixed on opposite positions, respectively.

Figure 4:
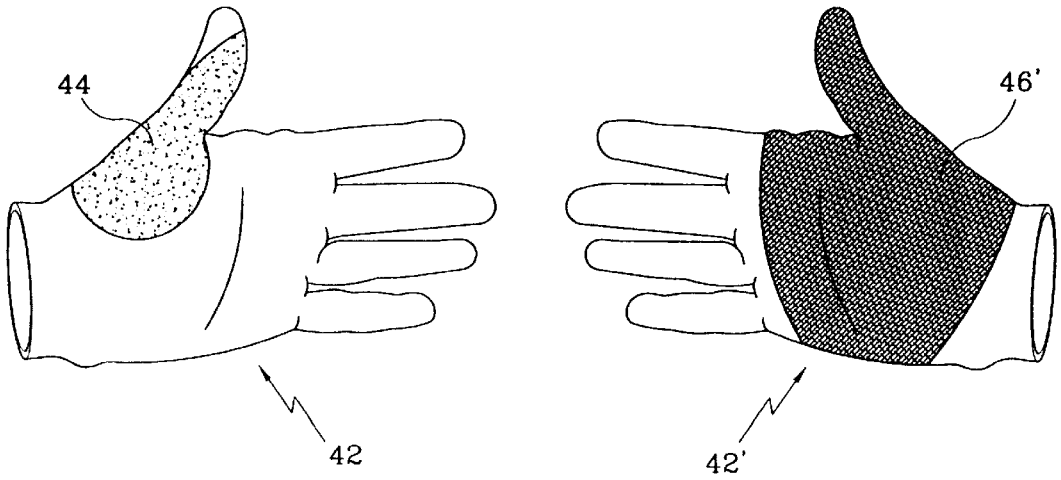
FIG. 4 is a view showing the palm sides of golf gloves according to a second embodiment of the present invention.

FIG. 4 is a view showing the palm sides of golf gloves according to a second embodiment of the present invention. In this embodiment, the hook piece 46' of the tape is fixed on the palm side of the thumb and the entire palm of the right hand glove 42'. The remaining construction of the second embodiment is the same as the corresponding construction of the first embodiment.

Figure 5:
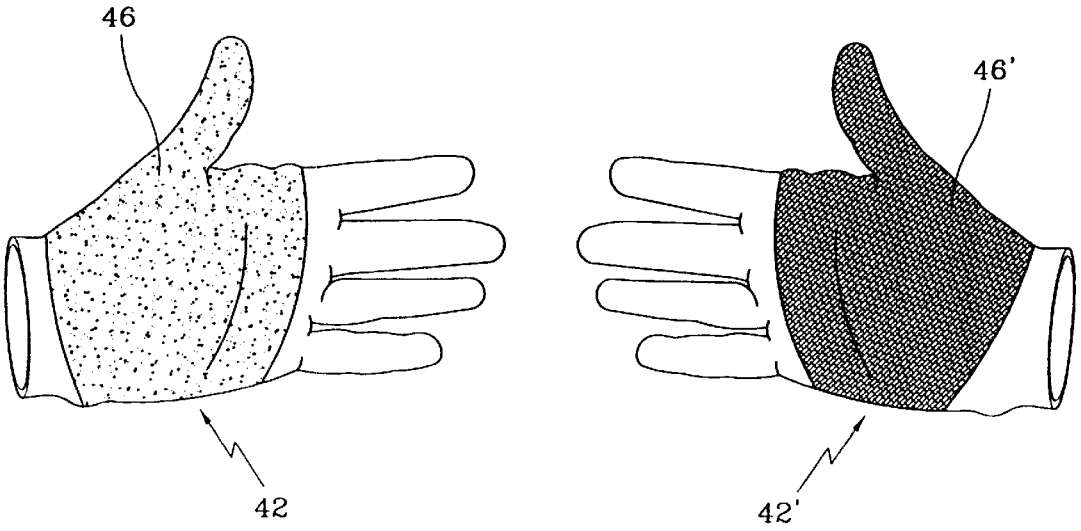
FIG. 5 is a view showing the palm sides of golf gloves according to a third embodiment of the present invention.

FIG. 5 is a view showing the palm sides of golf gloves according to a third embodiment of the present invention. In this embodiment, the pile piece 46 of the tape is fixed on the palm side of the thumb and the entire palm of the right hand glove 42. The remaining construction of the third embodiment is the same as the corresponding construction of the second embodiment.

According to the first, second and third embodiments, since the pile piece 44, 44 or 46 on the left hand glove 42 is interlocked together with the hook piece 44', 46' or 46' on the right hand glove 42' during a grip, the heel pads of the palms of a golfer's both hands press fast the grip portion of a golf club, thus allowing the golfer to make a proper grip. As a result, the golfer is trained in making a proper grip when both wearing the gloves and, thereafter, when not wearing the gloves. In addition, since the golfer may grip a golf club tightly by an interlocking action of the Velcro hook and loop pieces tape, the force of gripping is improved, so that the transmission of power to the ball through the golf club is well performed.

Figure 6:
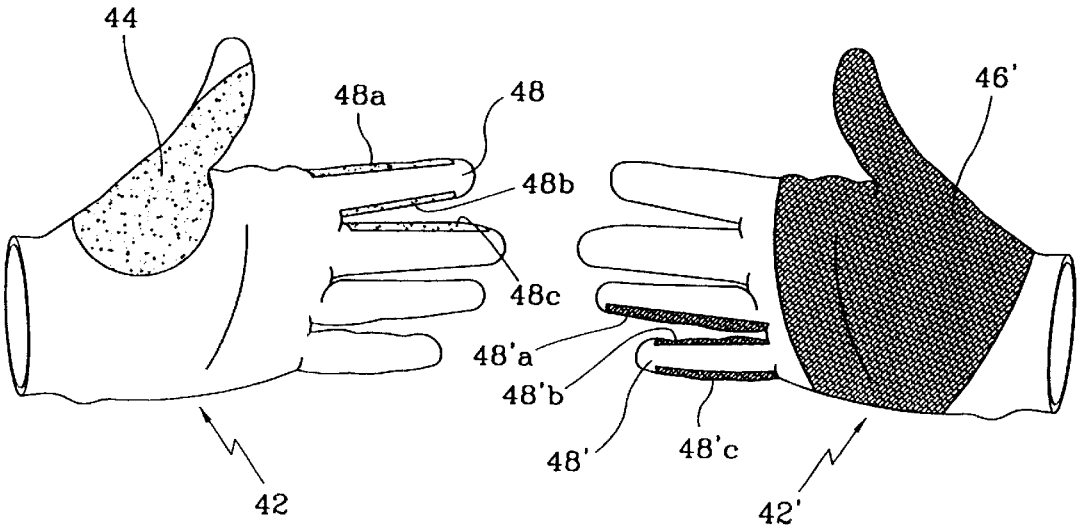
FIG. 6 is a view showing the palm sides of golf gloves according to a fourth embodiment of the present invention.

FIG. 6 is a view showing the palm sides of golf gloves according to a fourth embodiment of the present invention. In this embodiment, in addition to the construction of the second embodiment, the pile pieces 48 are respectively fixed on the side edges 48*a* and 48*b* of the index finger of the left hand glove 42 and the side edge 48*c,* adjacent to the index finger 48, of the middle finger of the left hand glove 42, while the hook pieces 48' are respectively fixed on the side edge 48'*a,* adjacent to the little finger, of the third finger of the left hand glove 42 and the side edges 48'*b* and 48'*c* of the little finger of the left hand glove 42.

According to the fourth embodiment, since an auxiliary fastening means is fixed on the contacted side edges of the interlaced fingers of the gloves, the power of gripping is more improved and the grip becomes more correct.

Figure 7:
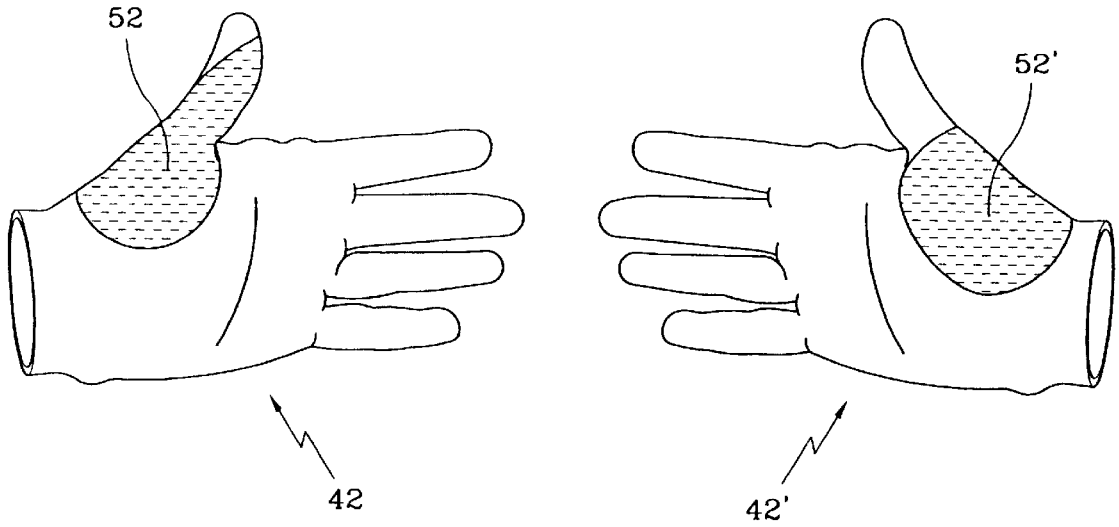
FIG. 7 is a view showing the palm sides of golf gloves according to a fifth embodiment of the present invention.

FIG. 7 is a view showing the palm sides of golf gloves according to a fifth embodiment of the present invention. Two adhesive pieces 52 and 52' coated with adhesive are respectively formed on the palm side of the thumb and the heel pad of the palm of the left hand glove 42 and the heel pad of the palm of the right hand glove 42', so that the adhesive pieces 52 and 52' may adhere to each other.

A fastening means is not limited to the Velcro hook and loop pieces tape and the adhesive pieces, but may be various. Additionally, the fastening means may be fixed around the entire exteriors of the gloves.

As described above, the present invention provides golf gloves allowing the heel pads of the palms of a golfer's both hands to continuously press fast the grip portion of a golf club during a whole swing action, thereby making and keeping a proper grip.

The present invention is to provide golf gloves allowing a golfer to master a proper grip through practice using the gloves so as to train a golfer to make a proper grip even with the gloves being removed.

The present invention is to provide golf gloves improving the force of gripping while swinging a golf club, thereby allowing a golfer to transmit power to a golf ball.

Further, the present invention is to provide golf gloves allowing a golfer to recognize when the proper grip is loosened through sound generated by the separation of fastening means.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A pair of golf gloves comprising:

a left glove and a right glove, each of said gloves having a portion of a cooperating fastening part covering at least a heel pad of the glove, wherein the cooperating fastening parts of both of the gloves additionally cover a thumb portion and a majority of a palm portion of the glove so that when the gloves are used to grip a golf club, the gloves are fastened together.

2. A pair of golf gloves as defined in claim 1, further comprising further cooperating fastening parts on one glove disposed along at least one side of an index finger portion and along at least one side of a middle finger portion.

3. A pair of golf gloves as defined in claim 2, further comprising additional cooperating fastening parts on the other glove disposed along at least one side of a fourth finger portion and along at least one side of a pinkie finger portion.

4. A pair of golf gloves as defined in claim 1, further comprising further cooperating fastening parts on one glove disposed along at least one side of an index finger portion and along at least one side of a middle finger portion, and additional cooperating fastening parts on the other glove disposed along at least one side of a fourth finger portion and along at least one side of a pinkie finger portion.

5. A pair of golf gloves as defined in claim 4, wherein the cooperating fastening part and the further cooperating fastening parts of one glove are hook fastening structures and the cooperating fastening part and additional cooperating fastening parts of the other glove are loop fastening structures.

6. A pair of golf gloves as defined in claim 1, wherein the cooperating fastening part of one glove is a hook fastening structure and the cooperating fastening part of the other glove is a loop fastening structure.

7. A pair of golf gloves as defined in claim 1, wherein the cooperating fastening parts of both gloves comprise adhesive pieces.

* * * * *